US006634035B1

(12) United States Patent
Fletcher et al.

(10) Patent No.: US 6,634,035 B1
(45) Date of Patent: Oct. 21, 2003

(54) SINK PLUNGER

(76) Inventors: Danielle Fletcher, 15410 Weatherrock Way, Salinas, CA (US) 93908; Bertarie Tindall, 70-599 Placerville, Rancho Mirage, CA (US) 92270

( * ) Notice: Subject to any disclaimer, the term of this patent is extended or adjusted under 35 U.S.C. 154(b) by 0 days.

(21) Appl. No.: 10/233,373

(22) Filed: Sep. 3, 2002

(51) Int. Cl.[7] ..... A47K 1/04; A47L 25/00; E03C 1/26

(52) U.S. Cl. ..... 4/255.11; 4/255.01; D32/35

(58) Field of Search ..... 4/255.11, 255.12, 4/255.05, 255.01, 661; D32/35

(56) References Cited

U.S. PATENT DOCUMENTS 1,088,459 A * 2/1914 Shade ..... 4/255.01 X
2,188,960 A * 2/1940 Schubring ..... 4/255.05
D292,835 S * 11/1987 Schaber ..... D32/35
5,488,749 A * 2/1996 Pearce et al. ..... 15/105
D398,104 S * 9/1998 Raines ..... D32/35

* cited by examiner

*Primary Examiner*—Gregory Huson
*Assistant Examiner*—Kathleen J. Prunner
(74) *Attorney, Agent, or Firm*—Richard E. Backus

(57) ABSTRACT

A plunger for use in manually pushing garbage down through the drain of a sink. The plunger is formed of a material that is sufficient light in weight for ease of use but also sufficiently hard to push the garbage. The plunger has a cylindrical shank that carries opposite bulbous distal ends. The distal ends have diameters which are sized larger than the shank so that a user can grasp either end to use as a hand hold while the other end pushes the garbage. The distal ends are shaped with flat pushing surfaces that have peripheral edges that are rounded to provide a smooth low friction action over the drain.

3 Claims, 1 Drawing Sheet

SINK PLUNGER

BACKGROUND OF THE INVENTION

1. Field of the Invention

This invention relates to plungers for use in a kitchen for users to push garbage down through sink drains.

2. Description of the Related Art

Garbage plungers have heretofore been used in kitchens for pushing garbage into sink drains. The prior art plungers of this type are held by a user for pushing garbage down through the drains for subsequent fragmentation by a mechanical garbage disposal unit. Many of these prior garbage plungers have certain limitations and disadvantages in that they can be unsafe when used while the disposal unit is in operation. Certain of the prior plungers are also difficult to use because of their unwieldy and cumbersome shapes. Certain of the prior plungers are also difficult to cleanse after use, such that if not properly cleansed they can be unsanitary when stored in a drawer or other storage area.

The need has therefore been recognized for a garbage plunger which obviates the foregoing and other limitations and disadvantages of prior art garbage plungers. Despite the various garbage plungers in the prior art, there has heretofore not been provided a suitable and attractive solution to these problems.

OBJECTS OF THE INVENTION

It is an object of this invention to provide a new and improved garbage plunger for pushing garbage through drains in kitchen sinks.

Another object is to provide a garbage plunger of lightweight yet hard and strong construction, which has an exterior surface that is optimal for sanitary cleansing, which is optimally shaped to enable a user to quickly pickup and hold either end in a comfortable grasp for ease of use in pushing down to move garbage through the sink drain, and which has its ends shaped in a manner that efficiently pushes garbage down while enabling a smooth low friction plunging action over the drain edges.

DESCRIPTION OF THE PREFERRED EMBODIMENTS

Figure 1:
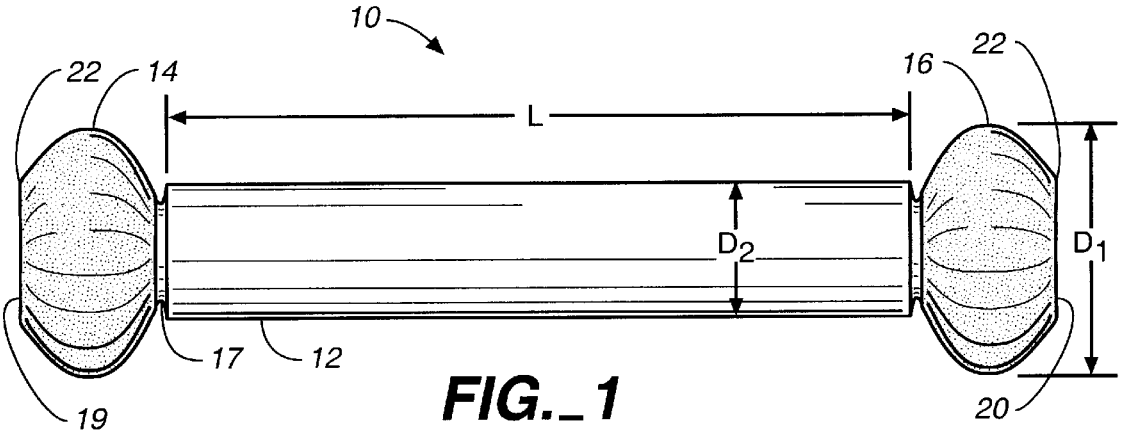
FIG. 1 is a side elevation view of a garbage plunger incorporating a preferred embodiment of the invention.

In the drawings FIG. 1 illustrated generally at 10 a garbage plunger in accordance with one preferred embodiment of the invention. Plunger 10 is comprised of an elongated cylindrical shank 12 and a pair of opposite distal ends 14 and 16 which can be formed integral with the shank, although they could be separate parts connected together, as desired. Decorative grooves 17 may be provided between the shank and distal ends. The plunger enables a user to safely push garbage down through a kitchen sink drain 18 into a garbage disposal unit, not shown, without the need for using a fork, spoon, spatula or his or her hand or finger.

One important aspect of the invention is that the shank and distal ends are formed of a material having a density that gives the plunger a weight which is sufficiently light for ease of handling by the user. The material further has a strength which is sufficient to enable the plunger to push fibrous or other difficult garbage through a sink drain while avoiding damaging the rotating blades of the electrical disposal unit should the plunger be inadvertently dropped by the user or pushed too far down. For these purposes the plunger material is selected from the group consisting of a hard wood, such as rosewood, and a hard synthetic polymer, such as an acrylic.

Another important aspect of the invention is that the exterior surfaces of the plunger are smoothed, such as by sanding in the case of wood, sufficient to enable sanitary cleansing, as by water and soap. This enables the user to maintain the plunger in a sanitary condition between uses while placed in a drawer or other storage area.

Figure 2:
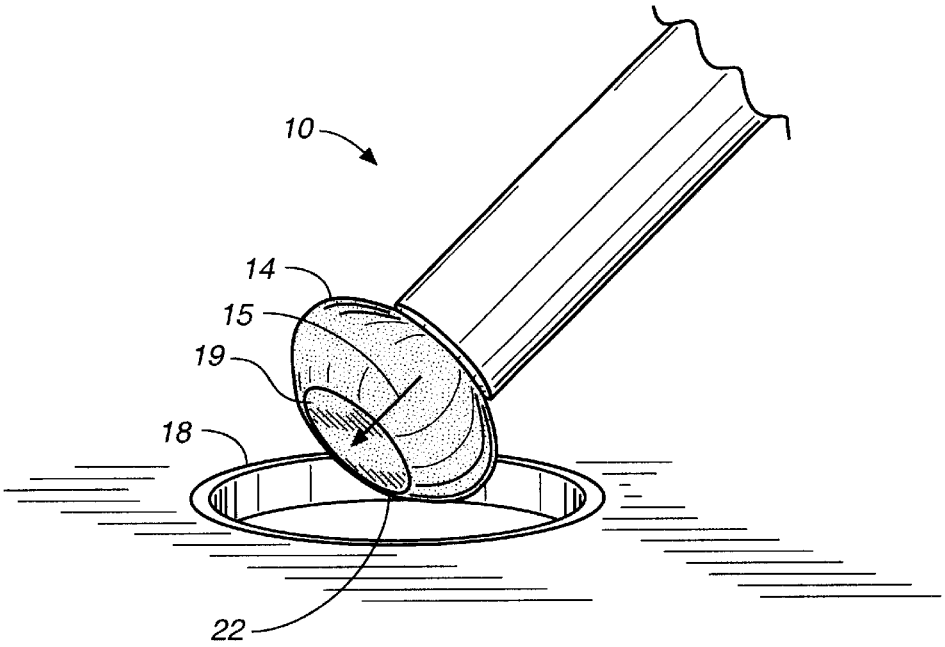
FIG. 2 is a perspective view of the garbage plunger of FIG. 1 showing its plunging action while in use in conjunction with a sink drain.

Another important aspect of the invention is that the distal ends 14 and 16 are both of bulbous shapes which are enlarged relative to shank 12 so that they can be used interchangeable as either a hand grip end or as a pushing end. This enables a user to quickly reach for and hold either end and then use it to push the opposite end down on the garbage, which is thereby forced through the drain opening in the manner shown by arrow 15 in FIG. 2. Preferably the distal ends are circular in cross section. The invention further provides a size relationship between the distal ends and shank which is optimum for both ease of grasping an end by the user's hand while also being of a diameter which is sufficiently large to provide an efficient pushing action against the garbage. For this purpose each distal end has a diameter $D_1$ in the range of substantially 1.25" to 2.25" while shank 12 has a diameter $D_2$ in the range of 0.75" to 1.00."

Another important aspect of the invention is that the shank has a length L which is sufficient such that the user's hand, when holding the plunger vertically from its topmost end, is safely above the drain and protected from any water and garbage that may splash out. For this purpose length L is in the range of 7" to 10 ."

Another important aspect of the invention is that the distal ends are formed with substantially flat faces 19, 20 on the sides which face away from the shank, The flat faces are of a size which is sufficient to provide an effective pushing surface which moves against and carries along a larger amount of garbage as compared to a rounded type pushing surface. For this purpose the flat faces have surface areas in the range of 1.2 $in^2$ to 3.9 $in^2$. Preferably the flat faces are circular.

Another important aspect of the invention is that perimeter edges 22 between the flat faces and the bulbous portions of the distal ends are rounded sufficiently to enable a smooth low friction plunging action over the drain edges as the plunger moves up and down. For this purpose edges 22 have radii of curvature in the range of 1/64" to 1/16." The rounded perimeter edges also enable a comfortable fit with the user's hand.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A plunger for use in manually pushing garbage through a drain in a sink, the plunger comprising the combination of an elongated cylindrical shank having a length in the range of 7" to 10", a pair of bulbous distal ends carried at opposite ends of the shank, the distal ends being formed of a material having a density that gives the plunger a weight which is sufficiently light for ease of handling by the user and the material further having a strength which is sufficient to enable the plunger to push fibrous or other difficult garbage through the sink, the shank and distal ends having exterior surfaces which are smoothed sufficient to enable sanitary cleansing after use, the distal ends being circular in cross section, the distal ends having diameters in the range of substantially 1.25" to 2.25" and the shank having a diameter in the range of 0.75" to 1.0," the distal ends each having a flat face which faces away from the shank, each flat face having a size which is sufficient to efficiently move garbage through the drain, the distal ends having perimeter edges about the flat faces, the perimeter edges being rounded sufficient to enable smooth low friction movement of the plunger through the drain.

2. A plunger as in claim 1 in which the material is selected from the group consisting of wood and a synthetic polymer.

3. A plunger as in claim 1 in which the sizes of the flat faces are in the range of 1.2 $in^2$ to 3.9 $in^2$.

* * * * *